US010774645B1

(12) United States Patent
Harmon, Sr.

(10) Patent No.: US 10,774,645 B1
(45) Date of Patent: Sep. 15, 2020

(54) HIGH EFFICIENCY STEAM ENGINE

(71) Applicant: Thermal Power Recovery LLC, Mahtomedi, MN (US)

(72) Inventor: James V. Harmon, Sr., Mahtomedi, MN (US)

(73) Assignee: THERMAL POWER RECOVERY LLC, Mahtomedi, MN (US)

( * ) Notice: Subject to any disclaimer, the term of this patent is extended or adjusted under 35 U.S.C. 154(b) by 0 days.

(21) Appl. No.: 16/397,246

(22) Filed: Apr. 29, 2019

Related U.S. Application Data

(63) Continuation-in-part of application No. 15/914,417, filed on Mar. 7, 2018, now Pat. No. 10,550,737, which is a continuation-in-part of application No. 15/794,486, filed on Oct. 26, 2017, now Pat. No. 10,273,840, which is a continuation-in-part of application No. 15/077,576, filed on Mar. 22, 2016, now Pat. No. 9,828,886, which is a continuation-in-part of application No. 13/532,853, filed on Jun. 26, 2012, now Pat. No. 9,316,130, which is a continuation-in-part of application No. 12/959,025, filed on Dec. 2, 2010, now Pat. No. 8,448,440.

(51) Int. Cl.

| | |
|---|---|
| ***F01B 25/10*** | (2006.01) |
| ***F01B 17/04*** | (2006.01) |
| ***F01L 35/04*** | (2006.01) |

(52) U.S. Cl.
CPC ..... *F01B 25/10* (2013.01); *F01B 17/04* (2013.01); *F01L 35/04* (2013.01); *F01B 2250/001* (2013.01); *F01B 2250/002* (2013.01)

(58) Field of Classification Search
CPC .... F01B 25/10; F01B 17/04; F01B 2250/001; F01B 2250/002; F01L 35/04
USPC ..... 60/670; 91/325, 241
See application file for complete search history.

(56) References Cited

U.S. PATENT DOCUMENTS

| | | | |
|---|---|---|---|
| 213,823 | A | 4/1879 | Knowles |
| 292,541 | A | 1/1884 | Craig |
| 309,610 | A | 12/1884 | Dow |

(Continued)

FOREIGN PATENT DOCUMENTS

| | | |
|---|---|---|
| DE | 102011116295 | 4/2013 |
| JP | 359099016 A | 6/1984 |
| WO | 2013004570 A1 | 1/2013 |

OTHER PUBLICATIONS http://www.kimmelstream.com/gelbart-uniflow.html, Dan Gelbart's Advanced Uniflow Steam Engine, Copyright © 2012, three pages.

*Primary Examiner* — Thai Ba Trieu
(74) *Attorney, Agent, or Firm* — Thomas J. Nikolai; DeWitt LLP

(57) ABSTRACT

A high efficiency uniflow steam engine having automatic poppet valves yieldably based by fluid such as steam held under pressure within a cavity in the engine and a cutoff control for closing a steam inlet valve at any time selected stops the flow of steam into the cylinder. Proximate the end of the exhaust stroke, around 0.12 inch before TDC the cylinder is sealed to thereby compress residual steam as the piston clearance approaches zero; typically, 0.020 inch which raises cylinder pressure enough to open an inlet valve without making physical contact to push the inlet valve open with the piston thereby eliminating a tappet type of noise, shock and wear.

24 Claims, 7 Drawing Sheets

(56) References Cited

U.S. PATENT DOCUMENTS

| | | | | | |
|---|---|---|---|---|---|
| 664,868 | A | | 1/1901 | Johnson | |
| 733,985 | A | | 7/1903 | Lundquist | |
| 1,047,912 | A | | 12/1912 | Bird | |
| 1,090,417 | A | | 3/1914 | Schmidt | |
| 1,167,527 | A | | 1/1916 | Schmidt | |
| 1,514,504 | A | | 11/1924 | Cohen | |
| 2,011,780 | A | | 8/1935 | Staley | |
| 2,099,701 | A | | 11/1937 | Metcalf | |
| 2,102,389 | A | | 12/1937 | Staley | |
| 2,295,962 | A | | 9/1942 | Mueller | |
| 2,402,699 | A | | 6/1946 | Williams | |
| 2,464,112 | A | | 3/1949 | Arnold | |
| 2,943,608 | A | | 7/1960 | Williams | |
| 3,279,326 | A | | 10/1966 | Harvey et al. | |
| 3,361,036 | A | | 1/1968 | Harvey | |
| 3,397,619 | A | | 8/1968 | Sturtevant | |
| 3,638,533 | A | * | 2/1972 | Sheridan | F01B 17/04 91/241 |
| 3,662,553 | A | | 5/1972 | Hodgkinson | |
| 3,668,974 | A | * | 6/1972 | Hagdorn | F01B 17/04 91/325 |
| 4,024,704 | A | | 5/1977 | Hudson | |
| 4,627,241 | A | * | 12/1986 | Johnston | F22D 11/06 91/325 |
| 5,010,852 | A | * | 4/1991 | Milisavljevic | F02B 69/06 123/71 R |
| 7,188,474 | B2 | | 3/2007 | van de Loo | |
| 7,363,893 | B2 | | 4/2008 | Rohe et al. | |
| 7,367,785 | B2 | | 5/2008 | Roberts | |
| 8,448,440 | B2 | | 5/2013 | Peoples et al. | |
| 8,661,817 | B2 | | 3/2014 | Harmon, Sr. et al. | |
| 9,316,130 | B1 | | 4/2016 | Harmon, Sr. et al. | |
| 9,657,568 | B2 | | 5/2017 | Bielenberg | |
| 9,784,147 | B1 | | 10/2017 | Harmon, Sr. | |
| 9,828,886 | B1 | | 11/2017 | Harmon | |
| 10,273,840 | B1 | | 4/2019 | Harmon, Sr. | |
| 2012/0324889 | A1 | | 12/2012 | Petitjean et al. | |

* cited by examiner

Fig 2

STEAM CONSUMPTION RATE OF THE INVENTION AND HIGH COMPRESSION ENGINE*

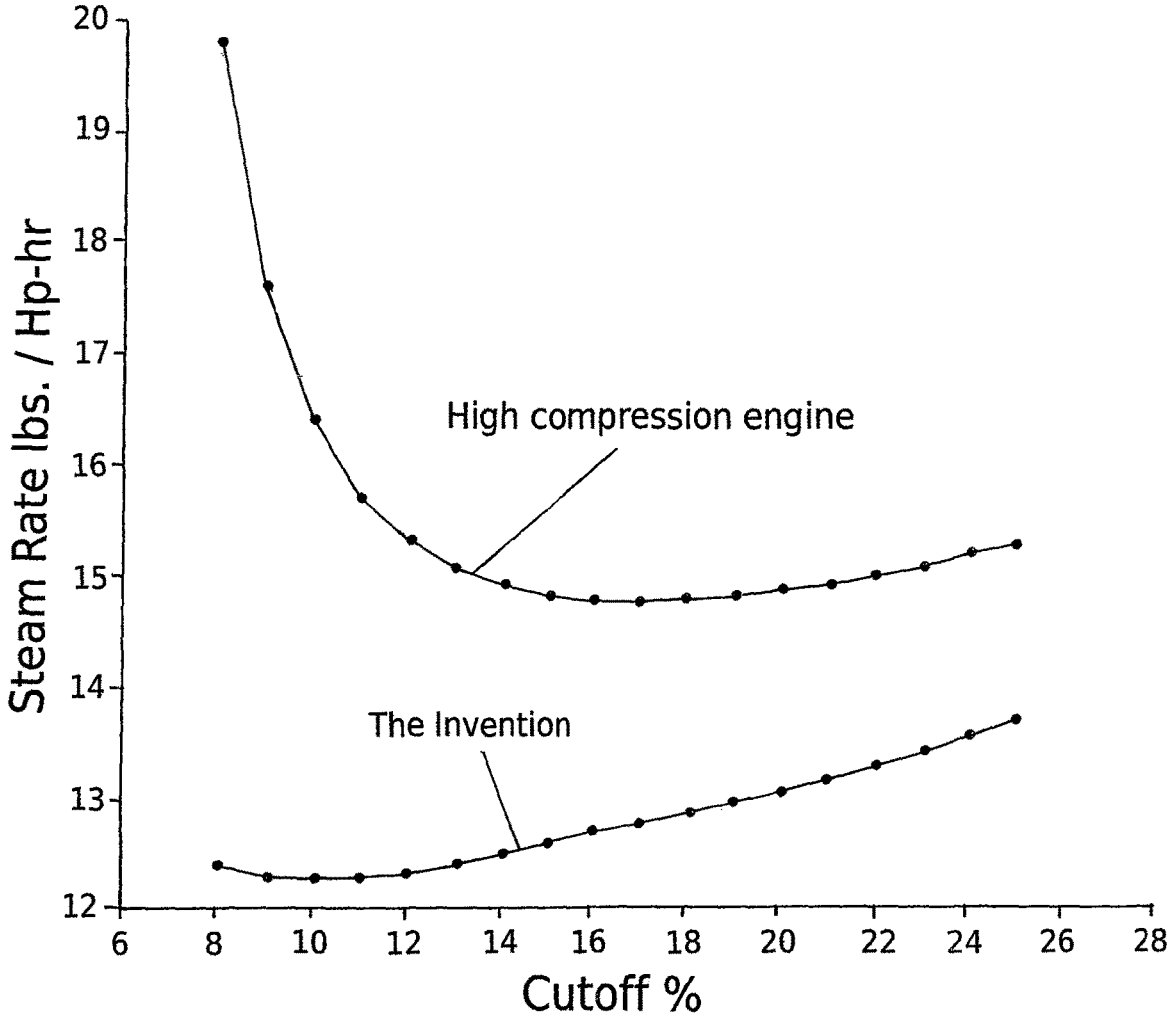

CONDITIONS:

| | | | |
|---|---|---|---|
| SUPPLY STREAM TEMRERATURE, R | = | 960.0 | 260°C |
| THROTTLE PRESSURE, psia | = | 363.0 | 25 Bar |
| COMPRESSION PRESSURE, psia (HCU) | = | 363.5 | 25 Bar |
| ENTHALPY CHANGE THROUGH GENERATOR | = | 1150.0 | Btu/lb. |
| CONDENSER SUCTION PRESSURE, psia | = | 7.25 | .5 Bar |
| COMPRESSIBILITY @ TS | = | 0.918 | |

*Assume 70% pump efficiency; Friction Assume $\frac{\text{.5ft-lb Torque}}{\text{In.}^3\text{ displacement}}$ 40
44
40
39
42
38
36
37
ECU
46
32
34
26
28
30
51
48
52
10
54
53
20
25
24
54
50
12
14
22
22
18

HIGH EFFICIENCY STEAM ENGINE

I. CROSS REFERENCE TO RELATED APPLICATIONS

The present application is a continuation-in-part of pending application Ser. No. 15/914,417 filed Mar. 7, 2018, which is a continuation-in-part of application Ser. No. 15/794,486 filed Oct. 26, 2017, now U.S. Pat. No. 10,273,840, which is a continuation-in-part of application Ser. No. 15/077,576 filed Mar. 22, 2016, now U.S. Pat. No. 9,828,886, which is a continuation-in-part of application Ser. No. 13/532,853 filed Jun. 26, 2012, now U.S. Pat. No. 9,316,130, which is in turn a continuation-in-part of Ser. No. 12/959,025, filed Dec. 2, 2010, now U.S. Pat. No. 8,448,440 all of which are incorporated herein by reference.

II. FIELD OF THE INVENTION

This invention relates to high efficiency steam engines and to improved valve mechanisms and operating methods for such engines.

III. BACKGROUND OF THE INVENTION

Much of the epic progress during the industrial revolution in the United States during the $19^{th}$ and $20^{th}$ century was powered by steam. However, the thermal efficiency of steam powered piston engines could not match that of the Otto or Diesel engines developed at the end of the $19^{th}$ century. A substantial improvement in steam engine efficiency was however made when the uniflow steam engine was developed by Professor Stumpf in Germany and improved further in the U.S. by C. C. Williams high compression uniflow engine based on compression as described in U.S. Pat. Nos. 2,402,699 and 2,943,608 in which steam is compressed to boiler pressure by the piston return stroke thereby raising the steam temperature for example 95 to 342 degrees hotter than feed steam in a sizeable clearance volume that may be 7% to 14.5% of displacement. The thermal efficiency of even these engines while improved, could not however reach that of the internal combustion engine.

Recently, a substantial further advance has been made through the development of steam engines operating on a cycle that employs essentially zero clearance between the piston and the cylinder head at the end of the exhaust stroke while at the same time any steam in the cylinder is under zero compression; a Z-Z operating principle. This arrangement achieves a remarkable increase in thermal efficiency as disclosed in U.S. Pat. Nos. 8,448,440, 9,316,130, 8,661,817, 9,828,886 and pending U.S. patent application Ser. No. 15/794,486 filed Oct. 26, 2017, now U.S. Pat. No. 10,273,840 all of which are assigned to the Applicant's assignee and incorporated herein by reference. Engines described in the latter five patents listed above provide a thermal efficiency which ranges from an improvement of about 15% to an extraordinary 59% better than the best performing high compression uniflow engines which are widely recognized to have the highest thermal efficiency of any steam engine previously known (see FIG. 1). The outstanding efficiency of the engines built according to the Z-Z patents listed above results from several factors including the Z-Z operating principle as well as benefits arising from the use of a unique, fast acting inlet valve which can open fully in some embodiments in less than 1 millisecond thereby avoiding losses formerly caused by a restriction in the flow of steam (also sometimes called "wire drawing") through the steam inlet valve while the valve is being opened by a cam or eccentric which may take as much as ⅓ to ½ of a crankshaft rotation resulting in reduced efficiency and power output. By contrast, since the inlet valve of Z-Z engines of the present invention is opened fully almost instantly while the piston clearance is virtually zero, work output begins at the highest steam supply pressure earlier in the cycle thereby providing more power while also eliminating losses associated with having to compress to supply pressure a substantial quantity of steam that remains in the cylinder. One aim of the present invention is to be able to achieve these advantages disclosed in the Z-Z patents listed above.

While efficiency has been greatly improved in the five patents listed, several deficiencies were discovered. Valve springs when overheated can lose their temper preventing peak performance. Fiber packing and other nonmetallic seals can create friction or become worn and leak. Valve lifters (projections between a valve and the piston) used to push valve open by piston motion can become weakened due to progressive fracture under cyclic loading over time.

In view of these and other deficiencies it is therefore one object of the present invention to retain the high efficiency and other advantages of the Z-Z engine patents noted above while actuating one or more valves by piston movement with little or no wear even when opening or closing the valve in under 1 millisecond.

Another object is to yieldably bias inlet and exhaust poppet valves without the need of springs.

Another object is to extend the working life of the engine valves subject to progressive fracture under cyclic loading while reducing the reciprocating mass of the valves and valve train.

Still another object is to find a way to retain the high thermal efficiency advantages of a zero clearance with zero compression operating principle while reducing the mass of a reciprocating valve train that includes one half the mass of the valve spring.

Another object is to eliminate or reduce leakage of working fluid while providing a way of actuating a steam inlet or exhaust valves without a camshaft system by timing at least one steam valve electrically using a computerized electric engine control unit (ECU) and without the necessity of forming valves from a ferromagnetic material.

It is a more specific object to maintain the high thermal efficiency that characterizes the virtual zero or near zero clearance with zero or near zero pressure steam cycle of U.S. Pat. Nos. 8,448,440, 9,316,130, 9,828,886 and Ser. No. 15/794,486, now U.S. Pat. No. 10,273,840 wherein steam admission is accurately timed and cut off automatically at any selected time using a relatively low mass steam inlet valve that is able to reciprocate at over 50 cycles per second without the need of a spring, cam shaft assembly or eccentric system and without a valve lifter on the piston that contacts the valve to push it open or closed.

Another object is to hold exhaust valves closed reliably yet assure that they can be opened with a small amount of valve work that does not significantly reduce thermal efficiency so as to thereby achieve higher overall thermal efficiency than the best reciprocating steam engines currently in commercial use.

These and other more detailed and specific objects and advantages of the present invention will be better understood by reference to the following figures and detailed description which illustrate by way of example but a few of the various forms of the invention within the scope of the appended claims.

SUMMARY OF THE INVENTION

This invention concerns a high efficiency steam engine having steam inlet and exhaust valves that communicate with a steam expansion chamber located in a cylinder between a piston and cylinder head. Steam inlet and exhaust valves are poppet type valves located in the cylinder head or piston, each having a stem mounted for reciprocation in a valve guide. One or more of the valve stems have a thrust surface either as a part of the stem, connected to the stem or on the end of a small valve piston at or attached to the stem. Each thrust surface is in a cavity containing fluid such as steam under pressure to produce a force which acts to open or close the valve proportional to the fluid pressure in the cavity. The exhaust valve is closed proximate an end of the exhaust stroke. Little or no clearance as described in U.S. Pat. Nos. 9,316,130 and 9,828,886 is provided between the piston and cylinder head. The steam inlet valve can be opened and then held open by a steam pressure differential across it. During the power stroke, the steam inlet valve is closed at a selected time to cut off steam admission to the cylinder under the control of an ECU or other timer.

In one embodiment, an armature on the exhaust valve is held in contact with an electromagnet by magnetic attraction so that when the current is turned off at a selected time, the pressurized fluid propels the armature away from the electromagnet closing the exhaust valve thereby cutting off the flow of exhaust steam out of the steam expansion chamber proximate TDC. In another embodiment of the invention the exhaust valve is forced shut by steam that is compressed within a recess in the exhaust valve by a plunger on the piston. This causes the steam expansion chamber to be sealed proximate but prior to an end of the exhaust stroke enabling a small residual quantity of steam then trapped in the steam expansion chamber to be compressed by movement of the piston at the termination of the exhaust stroke to a pressure sufficient to open the inlet valve due to the force exerted on the inlet valve by the steam compressed proximate TDC.

BRIEF DESCRIPTION OF THE DRAWINGS

FIG. 2 graphs the rate of steam consumption calculated per horsepower hour for the invention at various cutoff settings compared with the corresponding performance of an example of the most efficient high compression reciprocating steam engines previously known.

DETAILED DESCRIPTION OF THE PREFERRED EMBODIMENTS

Figure 1:
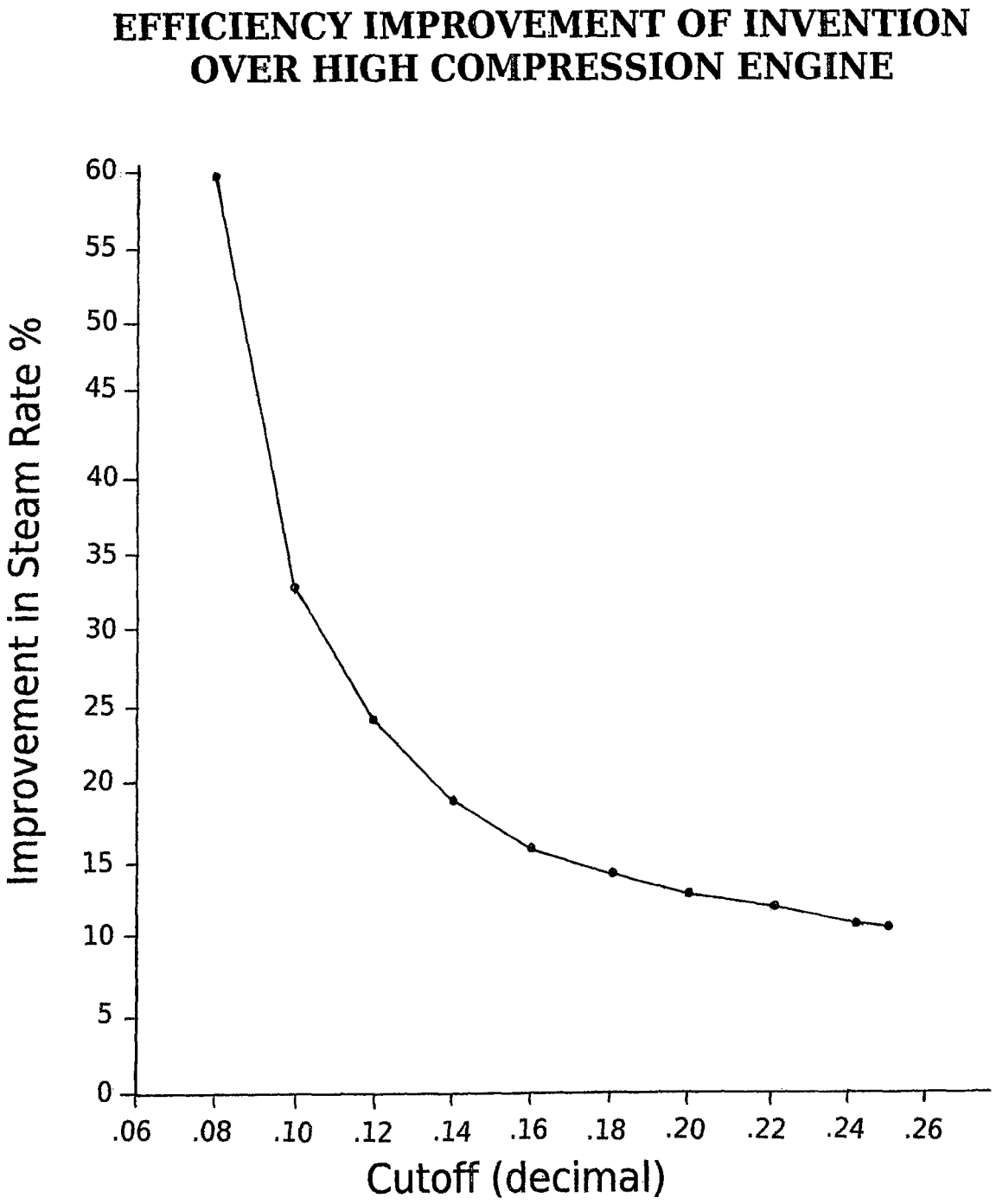
FIG. 1 is a graph showing the improvement in thermal efficiency of the invention computed from the performance graphs of FIG. 2.

Refer now to FIGS. 1 and 2 which show that a very sizeable improvement in thermal efficiency is provided by the present invention compared with what is generally acknowledged to be the most efficient uniflow steam engine design known. FIG. 1 (which is derived from FIG. 2) shows that at a 16% cutoff the thermal efficiency of the invention is over 15% better, at 12% cutoff it is almost 25% better and at an 8% cutoff where the prior art is at or near a stall condition there is an extraordinary 59% improvement of thermal efficiency in engines using the present invention. The present invention is about 20% better when each engine is run at its optimum efficiency. In a typical steam engine, the efficiency improves as the cutoff is lowered. FIG. 1 shows that it is in this lower cutoff range where the present invention makes possible the greatest improvement.

FIG. 2 illustrates in the upper graph the performance of a 2 cylinder double expansion high compression steam engine powered by biomass (wood) producing 473 hp to provide 300 KW @ an assumed 85% generator efficiency compared to an equivalent engine embodying the present invention with both operating under the same conditions listed in FIG. 2. The term "steam rate" in the Figures refers to the pounds of steam calculated using established thermodynamic relationships to produce a given power output. An inefficient engine of course consumes steam at a higher steam rate than an efficient one. For example in FIG. 2 the high compression compound engine of the prior art (upper graph) at a 10% cutoff consumes 15.6 lbs./hp-hr compared with 12.3 lbs./hp-hr for the invention. In FIG. 1 the efficiency improvement of the invention over the prior art at different cutoff values is computed by comparing the two graphs shown in FIG. 2. The thermodynamic formulas used for computing the results shown in FIG. 2 are given in Applicant's U.S. Pat. No. 8,448,440, Column 4, line 48 to Column 6, line 21.

Figure 3:
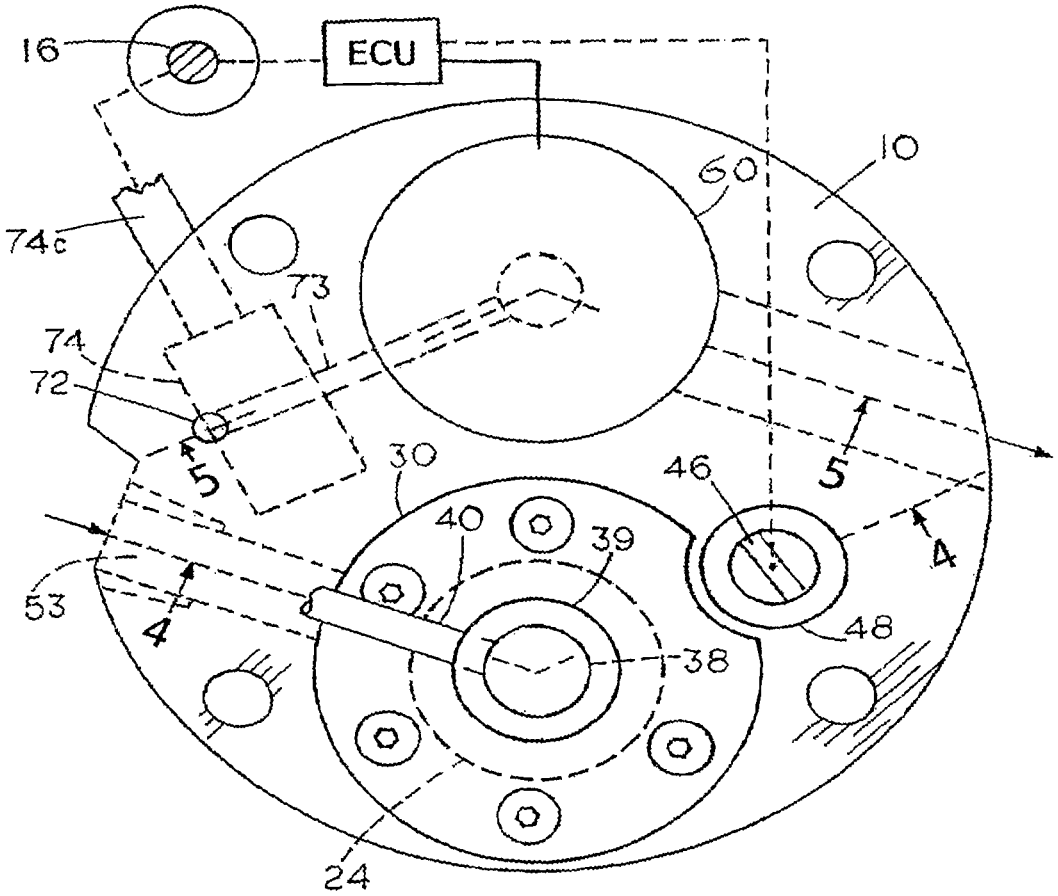
FIG. 3 is a top view of one engine cylinder embodying the invention.
Figure 4:
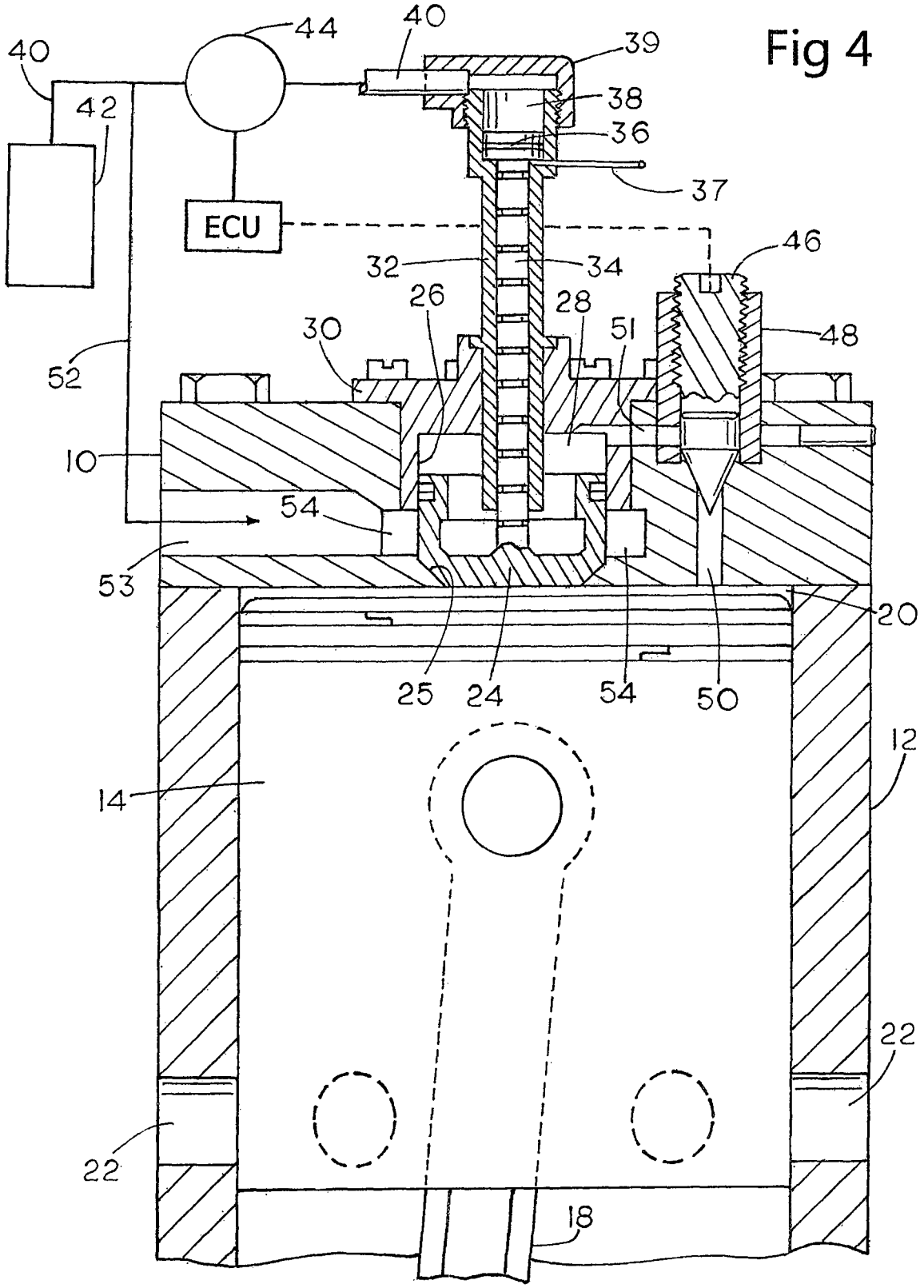
FIG. 4 is a vertical cross sectional view of the cylinder, cylinder head and piston taken on line 4-4 of FIG. 3 with the piston close to top dead center.
Figure 5:
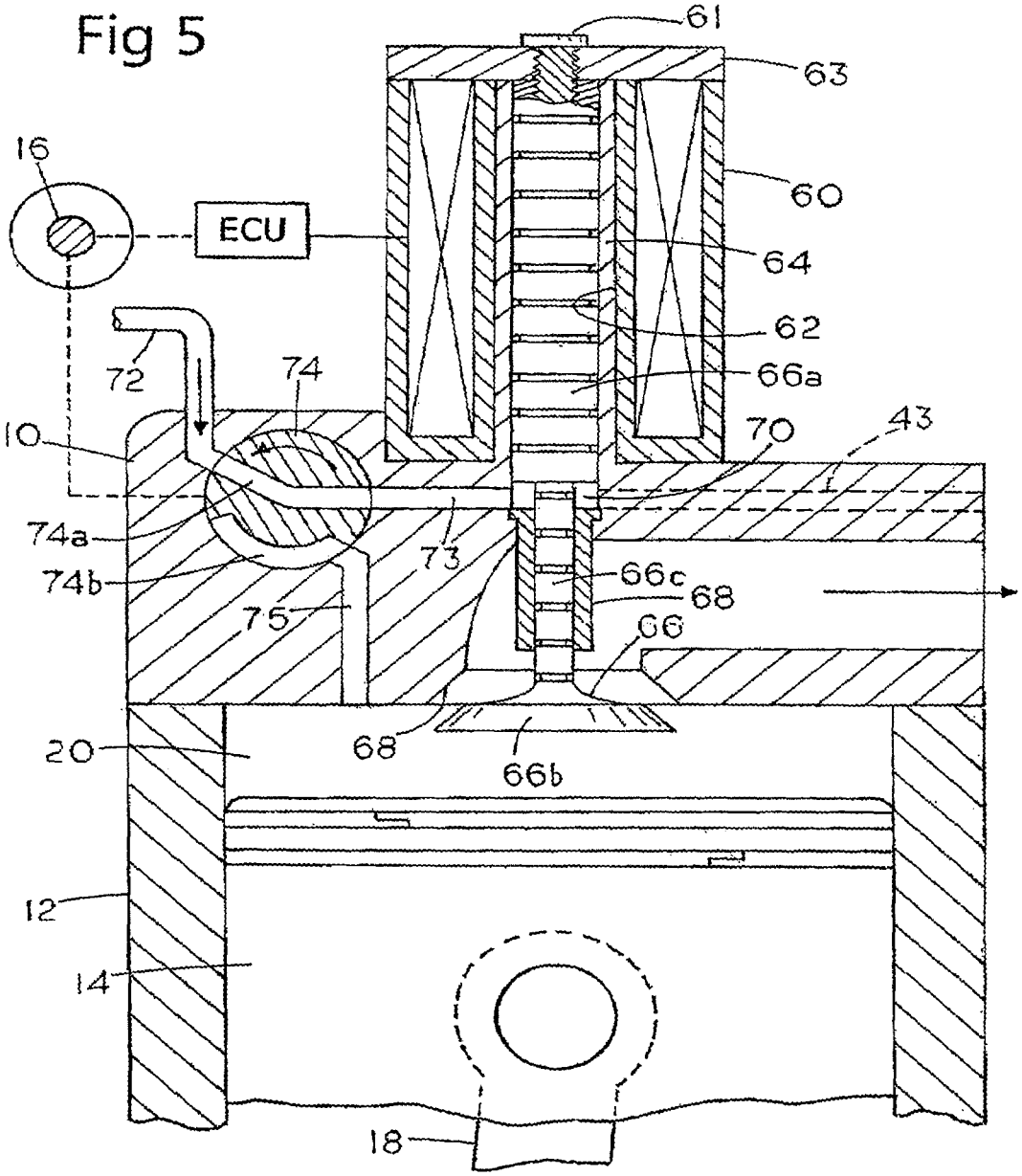
FIG. 5 is a vertical cross sectional view taken on line 5-5 of FIG. 3 showing the exhaust valve assembly.
Figure 5A:
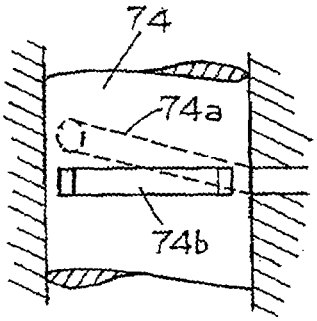
FIG. 5A is a partial bottom view of the selector valve 74 shown in FIG. 5.

Refer now to FIGS. 3-5 which illustrate a form of the invention having at least one cylinder using an electromagnet for opening a secondary exhaust valve. As best seen in FIGS. 4 and 5, the engine has a cylinder head 10 bolted to a cylinder 12 in which a piston 14 is sealingly and slidably mounted. The piston 14 is operatively coupled to a crankshaft 16 by a connecting rod 18 to form a steam expansion chamber 20 between the piston 14 and the cylinder head 10. The primary exhaust comprises several circumferentially spaced apart uniflow ports 22 in the cylinder 12 which open when the top of the piston 14 reaches its bottom center position at the end of each power stroke causing steam pressure in the chamber 20 to collapse to condenser pressure as it is returned to a condenser (not shown) in a closed circuit that is described for example in Applicant's prior U.S. Pat. No. 8,448,440.

Inlet valve 24 (FIGS. 3 and 4) has a cup shaped head slidably and sealingly mounted within an inlet valve bore 26 defining a cutoff control chamber 28 between the head of inlet valve 24 and a valve cover 30 which is fastened to the top of the cylinder head 10. The circular head of the valve 24 has a tapered surface that forms a seal on a valve seat 25. Extending through the cover 30 is a valve guide 32 in which the stem 34 of valve 24 is slidably mounted. Axially spaced apart grooves in stem 34 comprise a labyrinth seal in which each successive groove creates a disturbance that interrupts the outward flow of steam until flow is completely choked off without the use of fiber or rubber packing. At the upward end of the valve stem 34 is secured an inlet valve piston 36 which is slidably and sealingly mounted within a cylindrical valve cavity 38 in enclosure 39 that during operation is filled with a pressurized fluid such as steam, hydraulic fluid or lubricating oil introduced through a supply pipe 40 to apply pressure on a thrust surface at the top of piston 36. In this embodiment steam is used. The steam is fed from a steam generator 42 through pipe 40 to a pressure regulator 44 of suitable known commercially available construction to provide the desired closing force between the valve 24 and seat 25. The pressure regulator 44 can be adjusted by the ECU to change the closing force on valve seat 25 depending upon operating conditions such as RPM, load or other variables. Typically a moderate force of 30-60 lbs. on valve stem 34 is sufficient to hold it down. Any condensate or steam in the cavity 38 is returned to a condenser (not shown) through line 37.

A cutoff control valve 46 is threaded into a tube 48 affixed to the cylinder head 10 to control the rate at which high pressure steam passes through the ducts 50, 51 into the chamber 28. The further valve 46 is opened, the more rapidly chamber 28 will be filled with steam from chamber 20 thus reducing the time for the pressure in chamber 28 to equal that in chamber 20 which in turn results in a reduction in the cutoff of steam entering expansion chamber 20 from the steam generator 42 through pipes 52 and 53 into the circular steam chest 54 surrounding valve 24. It will be noted that the lower face of valve 24 is flush with the surrounding inward surface of the cylinder head and that the upper surface of the piston 14 is also flat so that the surfaces conform to one another. The clearance at TDC in chamber 20 is reduced to a very narrow gap preferably less than 0.125 inch and most preferably in the range of about 0.020 to about 0.030 inch as described more fully in Applicant's prior U.S. Pat. Nos. 8,448,440 and 9,316,130 for the purpose of achieving a greatly improved level of thermal efficiency as noted above in connection with FIGS. 1 and 2.

Refer now to FIGS. 3 and 5 which show diagrammatically an electromagnet 60 secured to the top of the cylinder head 10 and provided with a central bore 62 surrounding a valve guide 64 for the valve stem 66*a* of an exhaust valve 66 that has a valve head with a circular tapered surface 66*b* which when closed forms a seal on the tapered exhaust port 68. The upper part of the valve stem 66*a* has a larger diameter than a lower section 66*c* within valve guide 68 so as to form a cavity 70 that has a downwardly facing thrust surface within the valve guide 64. Attached to the free outward end of the upper part 66*a* of the valve stem by a screw 61 is an armature 63 that contacts the poles of the electromagnet 60 when valve 66 is open.

In operation, steam or other fluid enters the cavity 70 through supply pipe 72 and an optional rotating selector valve 74 that has a passage 74*a* for filling cavity 70 with, e.g., high pressure steam through passage 73 so as to close valve 66 by applying a moderate upward cyclical force, e.g., 30-60 lbs. intermittently on the upper thrust surface of cavity 70. A second passage 74*b* is provided for intermittently emptying cavity 70 into the steam expansion chamber 20 through passage 73 and 75 to reduce the load on electromagnet 60 when exhaust valve 66 is being opened. The valve 74 (FIG. 3) has a drive shaft 74*c* which is connected to rotate valve 74 at the speed of crankshaft 16. In this way the cavity 70 can be filled and emptied intermittently to alternately close exhaust valve 66 at TDC just as the power stroke begins and then empty steam from cavity 70 following the power stroke so that the electromagnet 60 can more quickly open the exhaust valve 66 during the exhaust stroke without being opposed by pressurized steam in cavity 70. If desired, instead of using valve 74, a two way type of reciprocating valve described below and shown in FIG. 6A can be used to cyclically fill and empty chamber 70 intermittently. During the power stroke, steam pressure in chamber 20 holds the exhaust valve 66 closed. When a steady, i.e., continuous yieldable biasing force on the exhaust valve is desired, steam can be fed directly from a pressure regulator 44 through passage 43 and neither of valves 74 or 82 is used.

Figure 6:
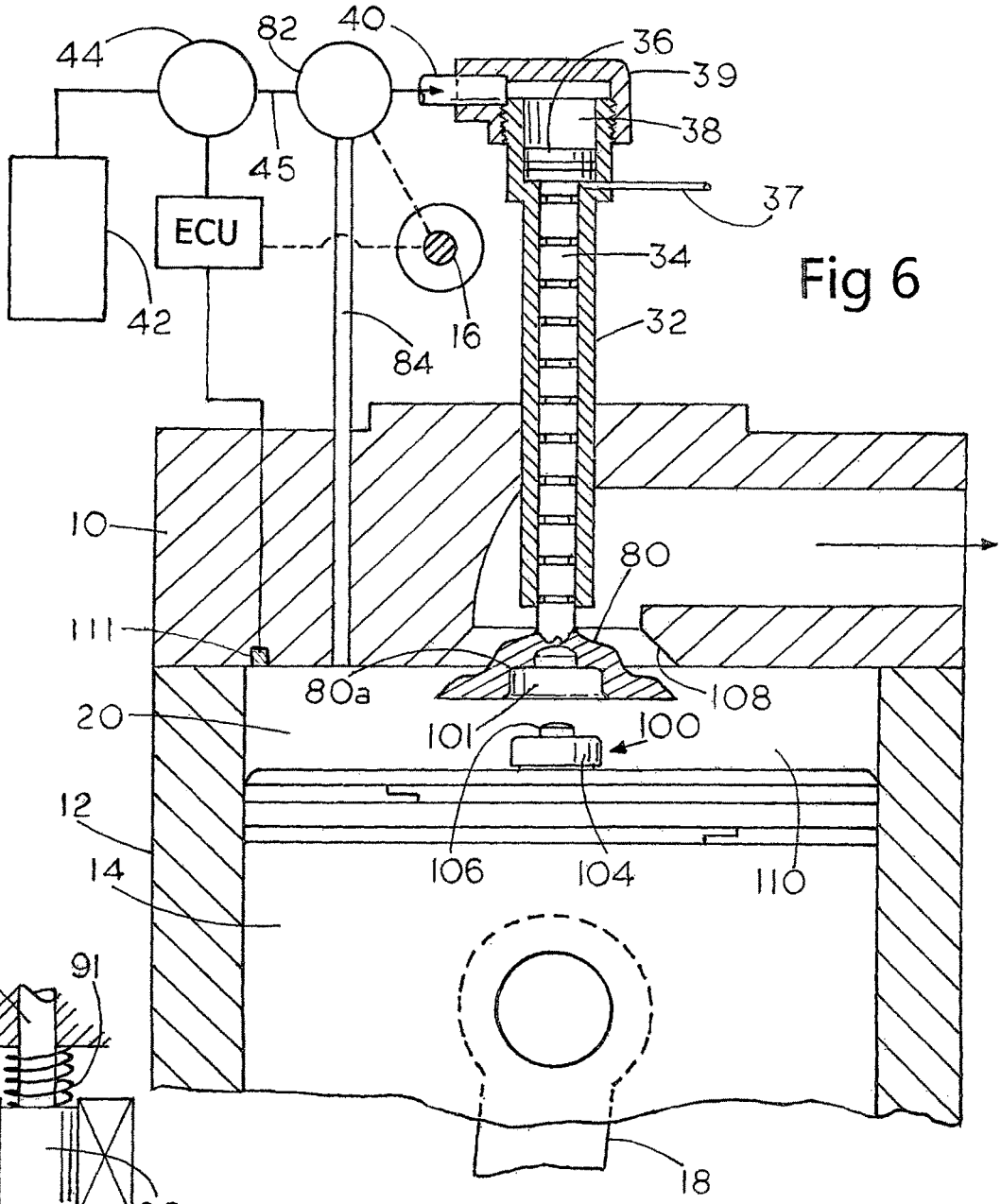
FIG. 6 is a partial vertical sectional view similar to FIG. 5 showing a different cylinder of the engine wherein the electromagnet is replaced by a fluid pressure cavity or chamber at one end of the exhaust valve.

Refer now to FIG. 6 which shows an embodiment of the invention in which fluid pressure is used to open an exhaust valve 80 in place of the electromagnet of FIGS. 3 and 5. In FIG. 6 downward valve opening pressure is provided by pressurized fluid as already described in connection with FIG. 4 and the same numbers refer to corresponding parts. The exhaust valve 80 has a valve stem 34 which reciprocates within a valve guide 32 as in FIG. 4. The steam in this example which is used for applying a downward pressure on valve 80 is supplied through a pipe 40 into the cavity 38 within enclosure 39 for applying either a continuous downward force on valve 80 to yieldably bias it to an open position or alternatively an optional two way selector valve 82 can be used.

Figure 6A:
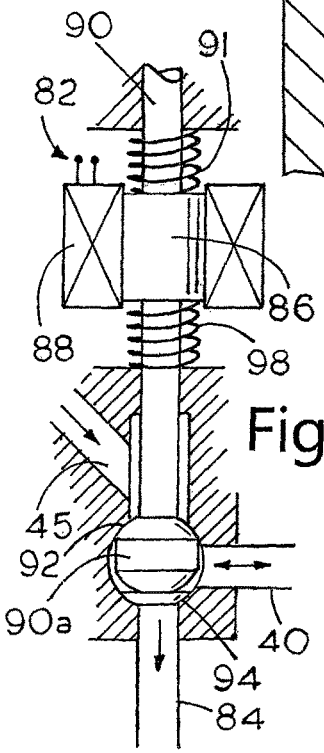
FIG. 6A is a diagrammatic illustration of an electric solenoid operated two-way valve shown in FIG. 6.

Refer now to FIG. 6*a* which shows how an intermittent downward force can if desired be provided on valve 80 through the operation of the selector valve 82 to direct high pressure fluid (steam) alternately through supply pipe 40 into chamber 38 when exhaust valve 80 is to be opened then out of chamber 38 through pipes 40 and 84 into the steam expansion chamber 20 when exhaust valve 80 is to be closed. In FIG. 6*a* a two way valve 82 is depicted diagrammatically for cyclically and intermittently filling and then emptying the chamber 38 through pipe 84 to the expansion chamber 20. Valve 82 is an electric solenoid operated valve similar to a fuel injector valve of the type used in the internal combustion engines of cars and trucks. In this example an armature 86 that is surrounded by solenoid 88 controlled by the ECU to run at engine speed and located near the center of valve stem 90 is slidably supported to oscillate between springs 91 and 98 for moving a valve head 90*a* at one end of the valve stem 90 axially between valve seats 92 and 94 to direct steam supplied from pressure regulator 44 through pipe 45 alternately; either into the chamber 38 through pipe 40 when valve 80 is opening or when valve head 90*a* is retracted as shown, steam will then flow back out of chamber 38 and through pipe 84 to the expansion chamber 20 thereby reducing the force required to seat valve 80.

Figure 7:
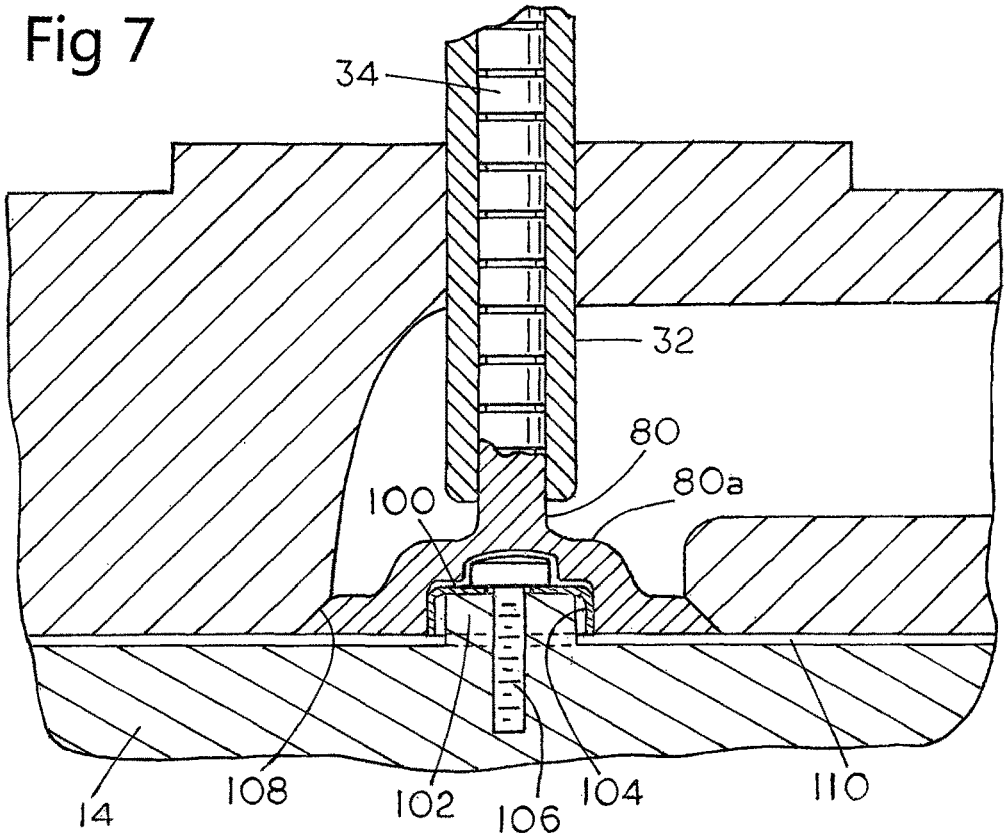
FIG. 7 is a partial enlarged view of FIG. 6.

To avoid efficiency losses caused by using eccentrics, cams, push rods and rockers, the intake and exhaust valves of the present invention are operated by piston movement without a part of the piston making physical contact with an inwardly facing surface of a valve. The exhaust valve 80 of FIG. 6 is closed by means of a plunger 100 (also shown in more detail in FIG. 7) mounted on the top of the piston 14 in position to enter an inwardly facing recess 101 in the inward surface of the head 80*a* of the exhaust valve 80. FIG. 7 shows how the piston 14 is provided with a cylindrical projection 102 on which an inverted cup-shaped circular cap 104 is held in place by a screw 106 that passes through a hole at the center of the cap 104 which is slightly larger than the shaft of the screw to allow the cap to move laterally slightly if necessary by engagement with the inside surface of the recess in case initial alignment is not optimal. If desired, the cap can be eliminated and projection 102 can be provided with spaced labyrinth grooves like those on the valve stems.

Alternatively, the valve 80 having no recess can be closed by an Inconel washer spring designated 43 in U.S. Pat. No. 8,448,440.

Briefly, the engine is operated as follows. Starting is accomplished with a suitable electric starter motor. Steam is exhausted in two phases; the primary exhaust is through the uniflow ports 22 and then during at least a first portion of the exhaust stroke steam is exhausted through the exhaust valve 80 mounted in the cylinder head. The expansion chamber 110 is then sealed by valve 80 late in the exhaust stroke when the piston is proximate but prior to a top dead center position to thereby limit the portion of the stroke during which steam is thereafter compressed within the expansion chamber. Valve 80 closes just after the plunger 100 shown in FIGS. 6 and 7 enters the recess 101. Steam which is then compressed within the recess 101 forces the valve upwardly to the closed position shown in FIG. 7 with the tapered circular edge of the valve 80 sealed against the valve seat 108. The plunger and recess 101 are dimensioned so that with the piston at TDC, the plunger cannot contact the back wall of the recess 101. Steam is then compressed in the steam expansion chamber 110 during the remaining terminal fraction of the exhaust stroke approaching zero clearance such that the compressed cylinder steam is able to open the inlet valve 24 (FIG. 4) at least partially with a level of compression work that is greatly reduced by beginning compression proximate TDC and compressing down to a narrow gap of, for example, 0.020 inch. The reduced valve work required assures that a high thermal efficiency is maintained.

Once the exhaust valve 80 is seated as shown in FIG. 7, the pressure from the blast of steam entering clearance volume 110 opens inlet valve 24 fully typically in less than 1 ms. and also holds the exhaust valve closed during the power stroke until the primary exhaust blow down through the uniflow ports 22 (FIG. 4) takes place whereupon steam pressure in cavity 38 opens the exhaust valve. The narrow gap (FIG. 7) defining the clearance 110 between the piston 14 in the cylinder head 10 is preferably much less than 0.125 inch and typically around 0.020 inch. Because of the pressure developed in the recess 101 as the piston approaches TDC, the exhaust valve will close proximate to but slightly before the piston reaches TDC at the terminal end of the exhaust stroke.

Adjustments to the steam pressure in the cavity 38 as initially selected by the operator and later by the ECU are used to set the piston clearance from the cylinder head when the exhaust valve becomes seated and this in turn determines the final pressure reached in the clearance volume 110 at TDC. The time between the cylinder pressure rise sent to the ECU from a pressure sensor 111 (FIG. 6) and TDC sent from crankshaft 16 to the ECU can be used by regulator 44 for controlling the pressure in cavity 38 of FIG. 6 to begin compression in chamber 20 at the time desired. A better understanding of operating conditions is made possible by graphing cylinder pressure vs. volume (PV) on a computer screen. Therefore with the components constructed and arranged as described, a very high pressure can be reached in chamber 110 with the expenditure very little work; and the pressure produced in the cylinder 12 in this way beginning when the clearance is for example 0.125 inch and ending when the clearance is 0.020 inch is much greater than that required to open the inlet valve 24 (FIG. 4) at least partially which in turn allows high pressure steam entering the minute clearance space to drive the inlet valve open fully, typically in less than 1 ms. Due to the small reciprocating mass of the inlet and exhaust valves as shown in the drawings, the forces required to accelerate the valves are substantially reduced. One test article had a bore of 3.75 inches, stroke of 3.07 inches and cylinder displacement of 564 mL. The weight of the 1 inch diameter titanium exhaust valve of the size shown in FIG. 6 was 0.08 pounds. This can improve both valve acceleration and the occurrence of valve float.

Figure 8:
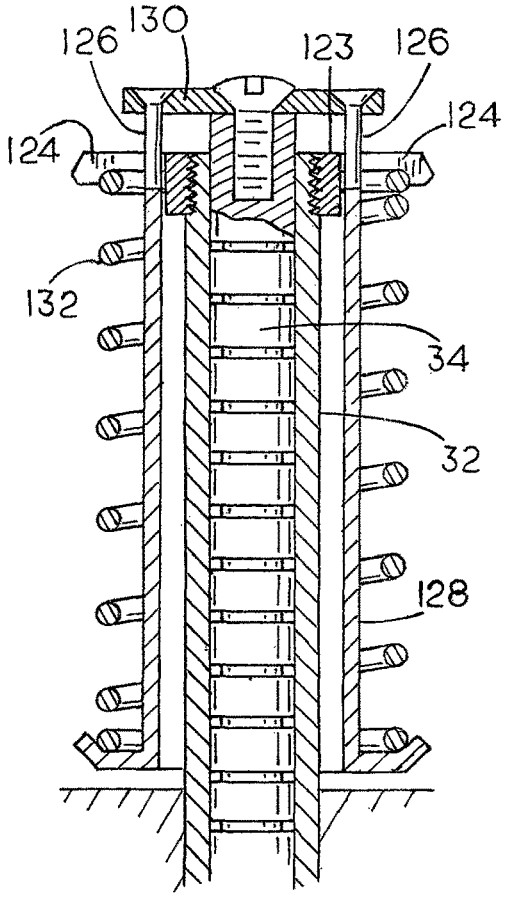
FIG. 8 is a view of a valve similar to those shown in FIGS. 4 and 6 in which an external spring is used.

Refer now to FIG. 8. When the pressure applied to the poppet valves does not need to be varied and the spring would not be adversely affected by heat, the spring operated valve of FIG. 8 can be used in place of the fluid operated valves of FIGS. 4 and 6. It can be seen that the valve stem 34 extends through a valve guide 32 that has a spring holder 123 secured to its upper end which is provided with several outwardly opening circumferentially spaced apart notches 124, through which extend an equal number of coupling rods 126 that are connected between a spring retainer tube 128 which also acts as a heat barrier and an end plate 130 that is secured to the outer end of the valve stem 34. Tube 128 can be formed from a low thermal conductivity alloy such as stainless steel type 304 or Hastelloy C with a fibrous or ceramic liner. A compression spring 132 is mounted between the end plate 130 and the tube 128 to exert a downward force on the valve stem 34. Placement of the spring outside of the heat barrier 128 where it is exposed to the cooling effect of the surrounding air helps to prevent it from overheating.

The various features and benefits of the present invention working together even make it possible in some embodiments of this invention to achieve a thermal efficiency exceeding that of a steam turbine in smaller sizes, such as those under 1000 horsepower while also having a lower cost. The features and advantages noted above also make the invention well suited for applications such as electric power generation or the co-generation of heat and power as well as to power a vehicle or to generate solar power and as a steam expander for an internal combustion engines to recover waste heat. A major advantage of the invention over internal combustion engines is its ability to use a variety of low grade fuels including waste or unrefined liquid fuels and low cost biomass without producing harmful nitrogen compounds generated by internal combustion engines.

Many other variations within the scope of the appended claims will be apparent to those skilled in the art once the principles disclosed herein are read and understood.

What is claimed is:

1. A steam engine comprising;

at least one cylinder having a steam expansion chamber and a piston that is sealingly and slidably mounted in the cylinder at one end of the steam expansion chamber and is operatively connected to a crankshaft;

a steam inlet valve that in a closed position seals a port in the engine which communicates between a pressurized steam supply passage and the steam expansion chamber;

a steam exhaust valve communicating with the steam expansion chamber for enabling steam to be exhausted from the expansion chamber following each power stroke of the piston;

wherein at least one of said steam inlet valve and said steam exhaust valve has a valve stem operatively associated with a cavity of the engine; and wherein a thrust surface is operatively associated with the valve stem and is located in the cavity of the engine for actuating at least one of said steam inlet valve and said steam exhaust valve in response to the pressure of a fluid supplied to the cavity of the engine such that the fluid exerts a force on the valve stem for imparting movement thereto in a first direction along an axis extending between an open and a closed position.

2. The engine of claim 1, wherein a pressure regulator is operatively associated with the cavity of the engine for controlling the pressure of the fluid in the cavity of the engine such that the force exerted on the thrust surface of said at least one of said steam inlet valve and said steam exhaust valve in the first direction by the fluid is controlled to enable said at least one of said steam inlet valve and said steam exhaust valve to be moved by a force that opposes the force applied by the fluid to thereby move the valve toward the cavity of the engine.

3. The steam engine of claim 2, wherein the greater force opposing the first force is provided by a plunger on the piston that is positioned to enter a recess in the steam exhaust valve for generating a pressure in the recess that acts to move the valve toward the cavity of the engine.

4. The steam engine of claim 1, wherein the engine is constructed and arranged to cyclically remove the fluid pressure in the cavity of the engine to facilitate intermittently moving said at least one of said steam inlet valve and said steam exhaust valve in a direction that opposes the fluid pressure applied to said at least one of said steam inlet valve and said steam exhaust valve.

5. The steam engine of claim 4, wherein the pressure in the cavity of the engine is removed intermittently by a selector valve operated in timed relationship with the piston strokes.

6. The steam engine of claim 5, wherein the selector valve is a rotary valve that has a passage which cyclically admits fluid into the cavity of the engine and a second passage for cyclically releasing fluid from the cavity of the engine.

7. The steam engine of claim 5, wherein the selector valve is an electrical solenoid operated valve having a reciprocating armature that is connected to a movable valve element which opens and closes the selector valve.

8. The steam engine of claim 5, wherein the selector valve is a two way valve for pressurizing the cavity of the engine in one position and evacuating the cavity of the engine when in a second position.

9. The steam engine of claim 1, wherein the second force opposing the first force is provided by an electromagnet having an armature connected to the stem of the steam exhaust valve.

10. The steam engine of claim 9, wherein the armature is held by magnetic attraction onto a pole of the electromagnet when the steam exhaust valve is open such that deactivation of the electromagnet enables the fluid force applied in the cavity of the engine to close the valve.

11. The steam engine of claim 10, wherein the steam exhaust valve is closed by the fluid pressure in the cavity of the engine and the fluid is released from the cavity of the engine during each exhaust stroke of the piston to enable the electromagnet to open the steam exhaust valve without being counteracted by the fluid pressure applied in the cavity of the engine to the exhaust valve.

12. The steam engine of claim 1, wherein the fluid pressure in the cavity of the engine is exerted on the steam exhaust valve in a direction to yieldably bias the steam exhaust valve toward an open position, the steam exhaust valve is closed by a steam compressed in a compartment between the steam exhaust valve and the piston to sufficient pressure to close the steam exhaust valve when the piston is proximate a top dead center position of the piston.

13. The steam engine of claim 12, including a selector valve communicating with the cavity of the engine to enable the cavity of the engine to empty proximate the compression of steam in the compartment to facilitate closure of the steam exhaust valve proximate a top dead center position of the piston.

14. The engine of claim 1, wherein the engine is constructed and arranged to enable steam to be exhausted from the expansion chamber during a part of each exhaust stroke and the expansion chamber then being sealed during the exhaust stroke when the piston is proximate but prior to a top dead center position to thereby limit the portion of the stroke during which steam compression occurs within the expansion chamber while enabling sufficient steam pressure to be produced in the cylinder during a terminal fraction of the exhaust stroke approaching top dead center such that the steam compressed in the cylinder is able to at least partially open the inlet valve.

15. A steam engine comprising:

at least one cylinder having a steam expansion chamber and a piston that is sealingly and slidably mounted in the cylinder at one end of the steam expansion chamber and is operatively connected to a crankshaft;

a poppet inlet valve that seals a port in the engine communicating between a steam supply passage and the steam expansion chamber, the inlet valve having a valve head and a valve stem slidably mounted in a valve guide and being yieldably biased to move the inlet valve toward a closed position;

a timer operatively associated with the inlet valve to control the closing time of the inlet valve for regulating the cutoff of steam into the expansion chamber;

a poppet exhaust valve with a valve stem that is operatively associated with a thrust surface located within a cavity in the engine for containing a pressurized fluid during operation to provide a yieldable bias on the exhaust valve stem by applying pressure against the thrust surface to move the exhaust valve in a first direction;

an electromagnet operatively associated with to the stem of the exhaust valve to move the exhaust valve in a direction opposing the first direction; and an electrical controller connected to actuate the electromagnet intermittently in timed relationship with rotation of the crankshaft whereby the exhaust valve reciprocates between an open and a closed position.

16. The steam engine of claim 15, wherein the engine is constructed and arranged to close the poppet exhaust valve proximate but prior to top dead center and thereafter prior to top dead center compress the remaining terminal fraction of residual steam within the expansion chamber to sufficient pressure to drive the poppet inlet valve to an open position.

17. The engine of claim 16, wherein the stem of the poppet inlet valve has a valve piston thereon that is located within the cavity of the engine for containing pressurized fluid during operation that yieldably biases the poppet inlet valve to a closed position by applying pressure to the thrust surface of the valve piston.

18. The steam engine of claim 15, wherein the thrust surface of the valve stem is defined at the junction within the cavity in the engine between two adjoining sections of the stem that have different diameters.

19. A steam engine comprising;

at least one cylinder having a steam expansion chamber and a piston that is sealingly and slidably mounted in the cylinder at one end of the steam expansion chamber and is operatively connected to a crankshaft;

a poppet inlet valve that seals a port in the engine communicating between a steam supply passage and the steam expansion chamber, the poppet inlet valve having a valve head and a valve stem slidably mounted in a valve guide and being yieldably biased to move the valve head toward a closed position;

a timer operatively connected to the inlet valve to control the closing time of the inlet valve for regulating the cutoff of steam into the expansion chamber;

a poppet exhaust valve having a valve stem that is yieldably biased to move toward an open position, the poppet exhaust valve is operatively associated with a thrust surface within the engine for applying the yieldable bias toward the open position; and a valve actuator constructed and arranged to close the poppet exhaust valve by compressed steam that is applied onto a surface of the poppet exhaust valve proximate top dead center until the exhaust valve is closed at a point in the piston cycle such that the piston thereafter compresses a remaining terminal fraction of the steam in the expansion chamber to sufficient pressure to at least partially open the steam inlet valve.

20. The engine of claim 19, wherein the poppet exhaust valve has a head with a recess therein facing the piston and the piston has a plunger thereon aligned to enter the recess for compressing steam therein to thereby close the poppet exhaust valve with a force applied to the exhaust valve by the steam compressed within the recess.

21. The engine of claim 19, wherein during operation of the engine the steam applies the yieldable bias on a thrust surface of a valve piston that is slidably and sealingly mounted within the cavity of the engine and is connected to the poppet exhaust valve stem and a pressure regulator is operatively connected to control the steam pressure within the cavity of the engine.

22. The engine of claim 19, wherein the yieldable bias acting upon the poppet exhaust valve is provided by a compression spring having ends connected between the valve stem and a part of the engine by a tubular thermal barrier concentrically interposed between the spring and the valve guide.

23. The engine of claim 19, wherein at least one of the poppet inlet valve and the poppet exhaust valve is yieldably biased axially by a spring that has a spring holder at one end thereof, the spring holder is operatively connected to a screw thread connector such that rotation of the screw thread connector moves the spring holder axially of the spring to thereby compress or extend the spring.

24. The engine of claim 21 wherein the fluid pressure provided in a passage communicating with the poppet inlet valve is regulated to select a yieldable closing force applied to the poppet inlet valve such that during operation of the engine the poppet inlet valve is opened by cylinder pressure developed when the piston approaches a position proximate top dead center.

* * * * *